United States Patent [19]

Steiner

[11] Patent Number: 4,830,202

[45] Date of Patent: May 16, 1989

[54] CLOTHES DRYING APPARATUS

[76] Inventor: Walter Steiner, Saentisstrasse 52, CH-8311 Bruetten, Switzerland

[21] Appl. No.: 134,939

[22] Filed: Dec. 18, 1987

[30] Foreign Application Priority Data

Dec. 22, 1986 [EP] European Pat. Off. ..... 86810610.5

[51] Int. Cl.[4] ..... A47F 5/00

[52] U.S. Cl. ..... 211/197

[58] Field of Search ..... 211/197, 119.01, 119.02, 211/119.1, 119.16, 1.3; 135/25 R

[56] References Cited

FOREIGN PATENT DOCUMENTS

| | | | |
|---|---|---|---|
| 473405 | 2/1975 | Australia | 211/197 |
| 686086 | 3/1965 | Italy | 211/197 |
| 390863 | 8/1965 | Switzerland | 211/197 |
| 400988 | 4/1966 | Switzerland | 211/197 |
| 1172534 | 12/1969 | United Kingdom | 211/197 |

*Primary Examiner*—Robert W. Gibson, Jr.

*Attorney, Agent, or Firm*—Tarolli, Sundheim & Covell

[57] ABSTRACT

The clothes drying apparatus (1) comprises four support arms (3) pivotably attached to a collar member (4) movable along a post member (2). Struts (8) are associated with respective arms (3). The clothes drying apparatus is folded by displacing the collar member (4) along the post member. Portions (7') of clothes line (7) extending between arms (3) hang down loose in the folded condition of the apparatus (1). A portion (7*a*) of a clothes line can be pulled out without extending the clothes drying apparatus to accommodate a small load or separate pieces. A locking device locks the pulled-out clothes line portion in a predetermined position. A pull-back device (16) may be provided for retracting the pulled-out portion (7*a*) inside of the folded apparatus (1).

12 Claims, 4 Drawing Sheets

CLOTHES DRYING APPARATUS

BACKGROUND OF THE INVENTION

The present invention relates to a clothes drying apparatus which comprises a central, elongate supporting post member, a collar member surrounding the supporting post member and being axially displaceably mounted on the supporting post member. The apparatus further comprises a plurality of support arms, one end thereof being pivotally mounted on the collar member, and a first clothes line constituting a plurality of clothes line portions which extend between the support arms.

The central supporting post member is equipped with a head member mounted on the top of the supporting post member, and a plurality of strut members, one end thereof being pivotally connected to the head member and the other end thereof being pivotally connected to one of the support arms.

Operating means are provided to spread the support arms from a rest position in which the arms are in an essentially parallel position to the central supporting post member, into an extended or spread out position in which the clothes line portions extending between the support arms are in an essentially stretched condition, by displacing the collar member from a lower rest position towards said head member into an operative position.

PRIOR ART

A clothes drying apparatus of this or a similar kind is known e.g. from Swiss Pat. No. 390,863, and further known from various different embodiments commercially available and in widespread use in households. Such an umbrella-like clothes drying apparatus is space saving, and can nevertheless accommodate a large laundry load. It can be brought from an operating position, in which clothes line portions are stretched between four spread support arms for receiving a laundry load, into a folded or rest position, in which the clothes line portions hang loose.

Even if these apparatus have proven very practical, reliable and space-saving, there is a major disadvantage: Anytime when pieces of clothes have to be dried the entire clothes drying apparatus has to be put into operation, i.e. the support arms have to spread out from their inoperative or rest position parallel to the central supporting post member in their spread out position in order to stretch the clothes line portions extending between the arms. Besides, large space is required for the spread-out frame and troublesome procedures need be performed for stretching and folding the frame of the apparatus. However, sometimes, only a very few pieces have to be hung onto the clothes line and it may be cumbersome to put the apparatus into operation.

OBJECTS OF THE INVENTION

It is a primary object of the present invention to improve an clothes drying apparatus of the prior art as hereinbefore discussed in a completely different and hitherto unknown manner so that the aforementioned disadvantages no longer occur.

Particularly, it is an object of the invention to improve a clothes drying apparatus of the kind referred to in such a manner that it may be ensured, using the same apparatus, to dry a few pieces of clothes in a quick and efficient manner without the need of a cumbersome unspreading of the support arms in order to expose the clothes line.

SUMMARY OF THE INVENTION

The invention provides a clothes drying apparatus which comprises a central, elongate supporting post member and a collar member surrounding the supporting post member which is axially displaceably mounted on the supporting post member. The apparatus further includes a plurality of support arms, one end thereof being pivotally mounted on the collar member, and a clothes line comprising a plurality of clothes line portions extending between said support arms.

A head member is mounted on the top of the supporting post member, and a plurality of strut members are provided, one end thereof being pivotally connected to the head member and the other end thereof being pivotally connected to one of the support arms.

In order to put the apparatus into the usual, normal operative position, i.e. from a rest position, in which the arms are in an essentially parallel position with regard to the central supporting post member, into an extended position in which the clothes line portions extending between the support arms are in an essentially stretched condition, the collar member is displaced under the effect of operating means from a lower rest position towards the head member.

In order that the same apparatus may be also used for a few pieces of clothes without the need of unspreading the support arms, first locking means are provided for locking at least one of said support arms in the rest position in which said support arm is essentially parallel to the supporting post member. Thereby, at least one of said clothes line portions which loosely hang down between adjacent support arms when said support arms are in said rest position has an end portion which can be pulled out from said support arm when said support arm is locked in the rest position by said first locking means.

Most known clothes drying apparatus have four arms which can be spread out. It is desirable that the four topmost sections of clothes line portions extending between the four arms can be pulled out in order to be able to pull out a sufficient length of the clothes line.

In order to prevent sagging of a pulled-out clothes line portion, it is desirable to provide, on the support arm, a locking device for the pulled-out clothes line portion. This may include, for example, a self-limiting eccentric device for gripping the pulled-out clothes line portion and having an outer suface tapering toward the arm surface.

For locking at least one arm, a catch with a hook-formed end or a slide is pivotably supported on the post member. Also, a slide displaceable along the post for engaging the arm and blocking it may be provided.

If all four arms are to be locked, an especially ingeneous possibility for locking the arms at the head end of the post member is to provide a hood which can be moved lengthwise along the post member and which, in the fixed position, grips over the outer surfaces of the arms.

To facilitate handling and to provide for withdrawal of the clothes line after use in its original position in which it hangs loose between the arms, a pull-back device may be provide, which may comprise, for example, a tension spring of which one end is fastened to a respective arm and the other end is attached to an eyelet that grips around a respective section of the clothes line portion and slides freely. In the case of a four-arm apparatus, a common pull-back device for two adjacent line portions is sufficient.

BRIEF DESCRIPTION OF THE DRAWINGS

In the following, a number of embodiments of the apparatus according to the invention will be further described, with reference to the accompanying drawings, in which.

Figure 1:
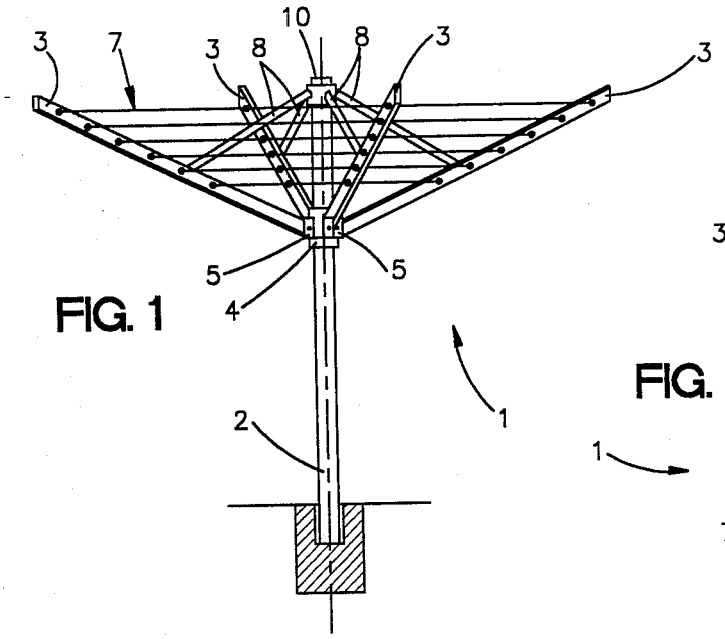
FIG. 1 is a schematic side view of an embodiment of a clothes drying apparatus according to the invention in an operative position, that is, an extended condition thereof.
Figure 3:
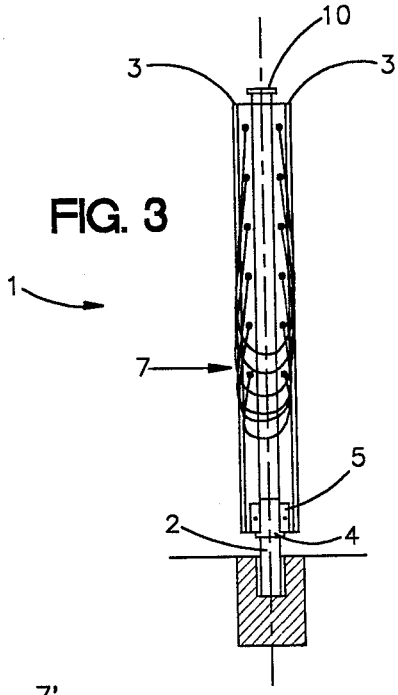
FIG. 3 is a schematic side view of the apparatus of FIG. 1, in a rest position thereof, that is, in a folded condition thereof.
Figure 2:
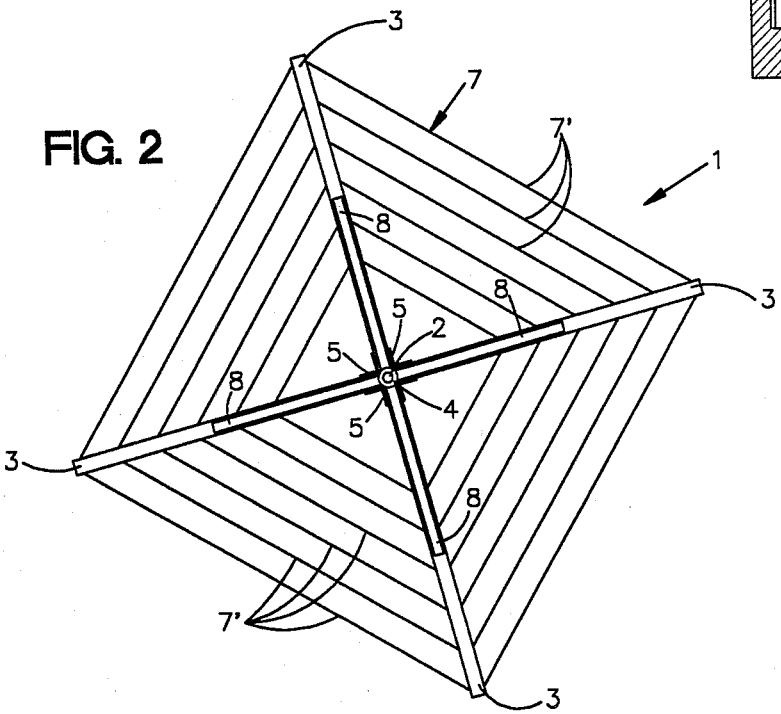
FIG. 2 is a top view of the apparatus according to FIG. 1.

In the described embodiment, the clothes drying apparatus 1 has four support arms 3 arranged in equidistant relationship around vertically extending post member 2. The arms together support a clothes line 7 which portions 7' extend between the support arms 3 when the support arms are in their spread-out position, (operative position of the clothes drying apparatus), as shown in FIGS. 1 and 3. The arms 3 are connected with the post member 2 through a collar member 4 slidably mounted on the post member 2. The collar member 4 has radially projecting webs 5 the which arms 3 are pivotably connected at the lower ends of the support arms. The support arms 3 are associated with struts 8 which are pivotably connected with respective support arms 3 at a distance from respective lower end at respective one ends of the struts. At their opposite ends remote from the one ends at which the struts are connected to the support arms, the struts are pivotably connected to a head member 10 arranged on the post member 2.

When the clothes drying apparatus 1 is not in use, the arms 3 are pivoted against the post member 2, and so are the struts 8. The collar 4 is in its lowest position, and the previously stretched portions 7' of the clothes line, hang loosely between the arms 3.

Figure 4:
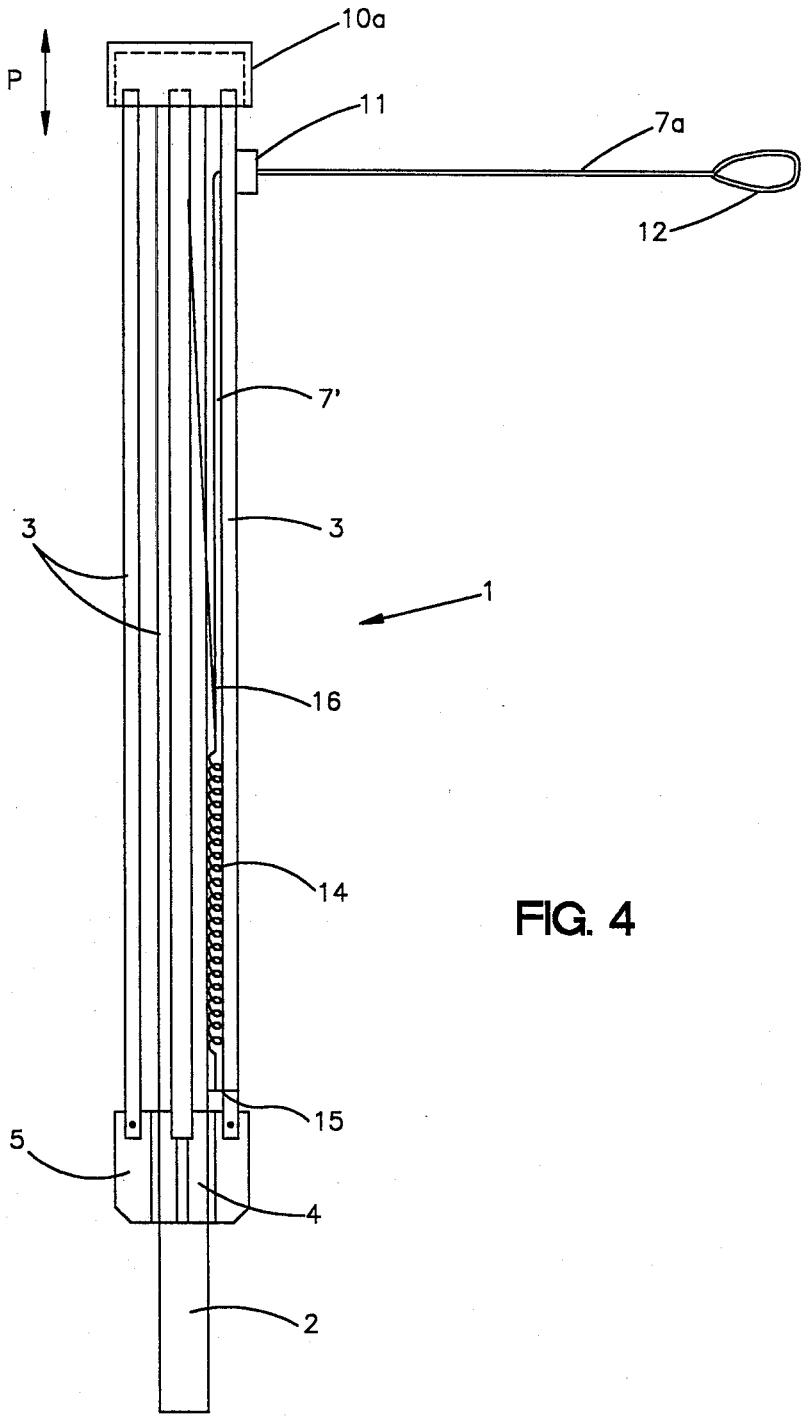
FIG. 4 is a schematic side view of a similar clothes drying apparatus in the rest position with a clothes line end portion being pulled out.

FIG. 4 shows a similified schematic view of the folded clothes drying apparatus in which portions 7a of the uppermost clothes line portion 7' are pulled out. At the end of the portion 7a, a loop 12 may be formed, so that the pulled out portion 7a can be anchored at a distance from the clothes drying apparatus 1, for example, to a hook in a house wall. If clothes are hung on the pulled out portion 7a, the portion 7a tends to sag. Therefore, a locking device 11 is provided on the support arm 3 from which the clothes line portion 7' is pulled out. The detailed form of it will be discussed later.

The respective support arm 3 would also have a tendency to pivot outwardly. Therefore, it must also be locked. To this end, in the embodiment of FIG. 4, the head member 10 of the post member 2 is designed as a hood 10a centrally located on the post member so that it grips over the ends of the support arms 3 when the arms are in the folded position. As indicated by arrow P, the hood-like head member 10a is movable lengthwise of the post member to free the arms 3 when the clothes drying apparatus is to be spread out.

The clothes drying apparatus of FIG. 4 is also equipped with a return spring 14 which has at one end thereof an eyelet 16 which grips around the clothes line portion 7', sliding freely. As a result, when the portion 7a and the locking device 11 are released, the portion 7a is retracted back and the clothes drying apparatus can be spread out with no trouble. The spring 14 may, if desired, be replaced by a weight, in order to retract the clothes line portion 7' back under the action of gravity.

Figure 6:
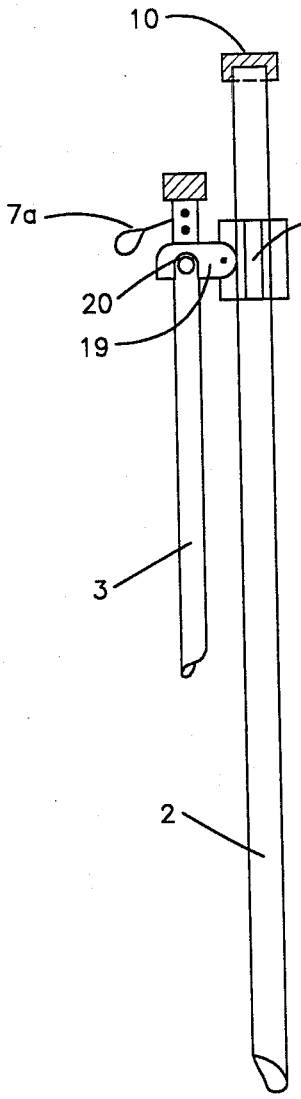
FIG. 6 is a detailed view of an arm locking device.
Figure 5:
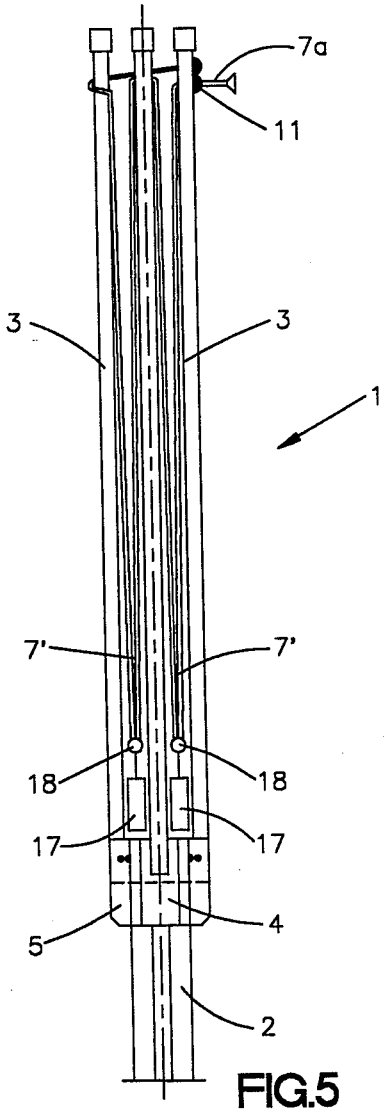
FIG. 5 is a variant of FIG. 4.

FIG. 5 shows another embodiment of the clothes drying apparatus 1. The basic structure that includes the post member 2, support arms 3, the collar and the clothes line 7 is the same. However, for retraction of the portion 7a of the clothes line 7, weights 17 are provided which have eyelets 18 that grip over the clothes line portions 7', sliding freely and, thus, when the portion 7a is released, and the clothes drying apparatus is folded, the weights pull the clothes line portions back. The way in which the arms 3 are locked, is shown in FIG. 6. Here only one arm 3 is schematically shown. The post member 2 carries a stop ring 9, to which a stop catch 19 is pivotably fastened. The respective arm 3 is provided with a bolt 20 which is being held by the catch 19 in a lock position. Another possibility (not shown) is to provide on the post member 2 a slide with an extension which can be moved lengthwise of the post member, and in the stop position of the arm 3, grips over the bolt 20.

Figure 7:
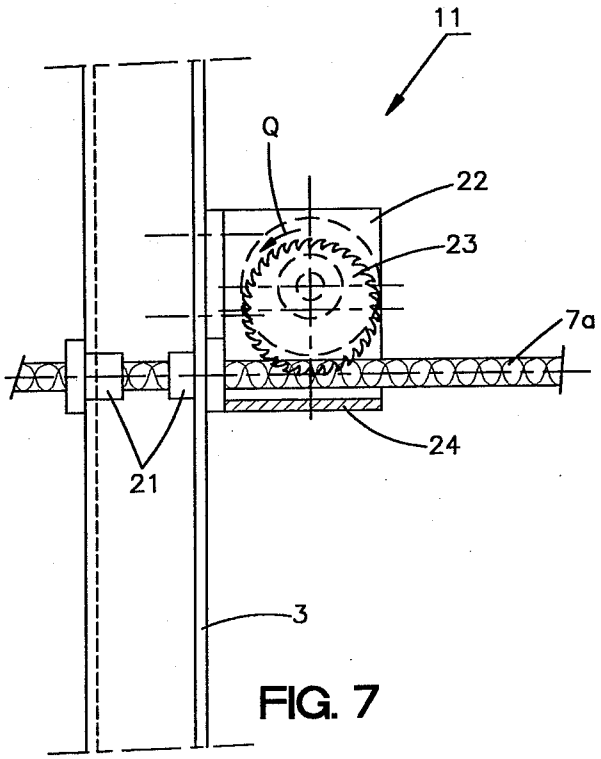
FIG. 7 is a partial view of a support arm comprising a first embodiment of a locking device for a clothes line portion.

FIG. 7 shows a first embodiment of a locking device for the pulled-out clothes line portion 7a. The clothes line 7 passes through the eyelet 21 of the arm 3, and the locking device 11 is arranged in the zone of the clothes line outlet. The locking device includes a plate 22, against which an eccentric disc 23 is rotatably supported. Its periphery is preferably grooved or serrated. The pulled-out clothes line portion 7a passes between the eccentric disc 23 and a bottom plate 24 of the locking device 11. When the eccentric disc is pivoted in the direction of arrow Q, the clothes line portion 7a is clamped and is effectively secured against being pulled out.

Figure 8:
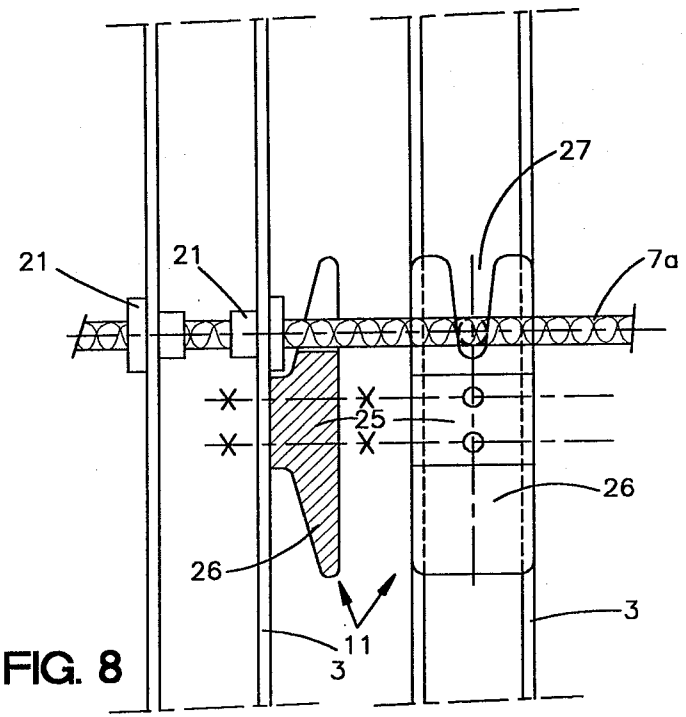
FIG. 8 is a partial view of a support arm comprising a second embodiment of a clothes line locking device.

A second embodiment of a locking device is shown in FIG. 8 which shows a side (left) and frontal view (right) of the locking device. The clothes line portion 7a again passes through eyelets 21 in the support arm 3, and a locking body in the form of a mushroom-like projection 25 is located in the zone of the clothes line outlet. The projection 25 has wing-like end parts 26 on opposite sides thereof, and the outer surface of the projection 25 is inclined toward the surface of the support arm. The upper end parts 26, in the drawing, have a middle slot 27, through which the clothes line portion 7a passes. Locking of the clothes line portion is effected by winding it about the mushrooum-like projection 25. The tapered outer surface of the projection 25 securely holds the clothes line portion 7a.

In a conventional four-arm clothes drying apparatus, four clothes line portions 7' are designed to be pulled out such that a pulled out portion 7a of about 6 to 8 meters in length is available. Here, it is enough if a pull-back device is provided on two opposite arms 3; whether in the form of a spring or a weight. The device acts simultaneously on two adjacent clothes line portions 7'.

Thus, it is possible to have in a conventional umbrella-type clothes drying apparatus additional clothes line portions which can be pulled out, and which, without a need to stretch out the frame, provide for drying of small loads (or individual pieces) and, if necessary, can be pulled out in a simple and rapid manner.

What I claim is:

1. A clothes drying apparatus comprising:

a central, elongate supporting post member;

a plurality of support arms for supporting a plurality of clothes line portions extending between said support arms;

a collar member mounted on said supporting post member for supporting said support arms, said support arms having one end pivotally attached to said collar member, said collar member being axially displaceable along said supporting post member between upper and lower positions in which said support arms are, respectively, in an extended position in which said support arms are spread out so that said clothes line portions extend between said support arms in an essentially stretched condition, and a rest position in which said support arms are essentially parallel to said supporting post member;

a head member mounted on the top portion of said supporting post member;

a plurality of strut members having one end thereof pivotally connected to said head member and the other end thereof pivotally connected to respective support arms;

first locking means for locking at least one of said support arms in said rest position in which said at least one support arm is essentially parallel to said supporting post member, whereby at least one of said clothes line portions which loosely hang down between adjacent support arms when said support arms are in said rest position, has an end portion which can be pulled out from said at least one support arm, when said at least one support arm is locked in said rest position by said first locking means; and second locking means provided on said at least one support arm for locking said pulled-out portion of said one clothes line portion.

2. A clothes drying apparatus comprising:

a central, elongate supporting post member;

a plurality of support arms for supporting a plurality of clothes line portions extending between said support arms;

a collar member mounted on said supporting post member for supporting said support arms, said support arms having one end pivotally attached to said collar member, said collar member being axially displaceable along said supporting post member between upper and lower positions in which said support arms are, respectively, in an extended position in which said support arms are spread out so that said clothes line portions extend between said support arms in an essentially stretched condition, and a rest position in which said support arms are essentially parallel to said supporting post member;

a head member mounted on the top portion of said supporting post member;

a plurality of strut members having one end thereof pivotally connected to said head member and the other end thereof pivotally connected to respective support arms; and first locking means for locking at least one of said support arms in said rest position in which said at least one support arm is essentially parallel to said supporting post member, whereby at least one of said clothes line portions which loosely hang down between adjacent support arms when said support arms are in said rest position, has an end portion which can be pulled out from said at least one support arm, when said at least one support arm is locked in said rest position by said first locking means;

said first locking means comprising a catch having a hook-like end and pivotably supported on said post member for locking said at least one support arm in said rest position of the arm by engaging the arm.

3. A clothes drying apparatus comprising:

a central, elongate supporting post member;

a plurality of support arms for supporting a plurality of clothes line portions extending between said support arms;

a collar member mounted on said supporting post member for supporting said support arms, said support arms having one end pivotally attached to said collar member, said collar member being axially displaceable along said supporting post member between upper and lower positions in which said support arms are, respectively, in an extended position in which said support arms are spread out so that said clothes line portions extend between said support arms in an essentially stretched condition, and a rest position in which said support arms are essentially parallel to said supporting post member;

a head member mounted on the top portion of said supporting post member;

a plurality of strut members having one end thereof pivotally connected to said head member and the other end thereof pivotally connected to respective support arms; and first locking means for locking at least one of said support arms in said rest position in which said at least one support arm is essentially parallel to said supporting post member, whereby at least one of said clothes line portions which loosely hang down between adjacent support arms when said support arms are in said rest position, has an end portion which can be pulled out from said at least one support arm, when said at least one support arm is locked in said rest position by said first locking means;

said first locking means comprising a slide displaceably supported on said supporting post member for locking said at least one arm in said rest position of the arm by engaging and gripping the arm.

4. A clothes drying apparatus comprising:

a central, elongate supporting post member;

a plurality of support arms for supporting a plurality of clothes line portions extending between said support arms;

a collar member mounted on said supporting post member for supporting said support arms, said support arms having one end pivotally attached to said collar member, said collar member being axially displaceable along said supporting post member between upper and lower positions in which said support arms are, respectively, in an extended position in which said support arms are spread out so that said clothes line portions extend between said support arms in an essentially stretched condition, and a rest position in which said support arms are essentially parallel to said supporting post member;

a head member mounted on the top portion of said supporting post member;

a plurality of strut members having one end thereof pivotally connected to said head member and the other end thereof pivotally connected to respective support arms; and first locking means for locking at least one of said support arms in said rest position in which said at least one support arm is essentially parallel to said supporting post member, whereby at least one of said clothes line portions which loosely hang down between adjacent support arms when said support arms are in said rest position, has an end portion which can be pulled out from said at least one support arm, when said at least one support arm is locked in said rest position by said first locking means;

said first locking means comprising a hood placed at the head end of said post member and movable therealong for locking said at least one support arm in said rest position of the arms by gripping over the outer surfaces of said at least one support arm.

5. A clothes drying apparatus comprising:

a central, elongate supporting post member;

a plurality of support arms for supporting a plurality of clothes line portions extending between said support arms;

a collar member mounted on said supporting post member for supporting said support arms, said support arms having one end pivotally attached to said collar member, said collar member being axially displaceable along said supporting post member between upper and lower positions in which said support arms are, respectively, in an extended position in which said support arms are spread out so that said clothes line portions extend between said support arms in an essentially stretched condition, and a rest position in which said support arms are essentially parallel to said supporting post member;

a head member mounted on the top portion of said supporting post member;

a plurality of strut members having one end thereof pivotally connected to said head member and the other end thereof pivotally connected to respective support arms;

first locking means for locking at least one of said support arms in said rest position in which said at least one support arm is essentially parallel to said supporting post member, whereby at least one of said clothes line portions which loosely hang down between adjacent support arms when said support arms are in said rest position, has an end portion which can be pulled out from said at least one support arm, when said at least one support arm is locked in said rest position by said first locking means; and a pull-back device for retracting the pulled-out portion of the clothes line.

6. A clothes drying apparatus comprising:

a central, elongate supporting post member;

a plurality of support arms for supporting a plurality of clothes line portions extending between said support arms;

a collar member mounted on said supporting post member for supporting said support arms, said support arms having one end pivotally attached to said collar member, said collar member being axially displaceable along said supporting post member between upper and lower positions in which said support arms are, respectively, in an extended position in which said support arms are spread out so that said clothes line portions extend between said support arms in an essentially stretched condition, and a rest position in which said support arms are essentially parallel to said supporting post member and said clothes line portions hang down between adjacent support arms;

a head member mounted on the top portion of said supporting post member;

a plurality of strut members having one end thereof pivotally connected to said head member and the other end thereof pivotally connected to respective support arms; and first locking means for locking at least one of said support arms in said rest position in which said at least one support arm is essentially parallel to said supporting post member to enable at least one of said clothes line portions which loosely hang down between adjacent support arms when said support arms are in said rest position to be pulled out from said at least one support arm when said at least one support arm is locked in said rest position by said first locking means and to be extended between said supporting post member and an anchoring member distantly located from said supporting post member.

7. A clothes drying apparatus according to claim 1, wherein said second locking device has an extension supported on the arm and comprising an outer surface tapering to the surface of the arm.

8. A clothes drying apparatus according to claim 1, wherein said second locking device comprises a self-limiting eccentric gripping over the pulled-out clothes line portion.

9. A clothes drying apparatus according to claim 5, wherein said pull-back device comprises a traction spring of which one end is fastened to a respective arm and the other end is connected to an eyelet for engaging a respective portion of the clothes line.

10. A clothes drying apparatus according to claim 5, wherein said pull-back device comprises a weight suspended by means of a freely sliding eyelet on a respective portion of the clothes line.

11. A clothes drying apparatus according to claim 5, wherein two adjacent portions of clothes line are associated with a common pull-back device.

12. A clothes drying apparatus according to claim 6, wherein said apparatus comprises four support arms which can be locked in said rest position by said first locking means, and wherein the four uppermost continuous portions of the clothes line extending between said support arms can be pulled out.

* * * * *